US005687461A

United States Patent [19]

Kohlen

[11] Patent Number: 5,687,461

[45] Date of Patent: Nov. 18, 1997

[54] YARN END ASPIRATION APPARATUS

[75] Inventor: Helmut Kohlen, Erkelenz, Germany

[73] Assignee: W. Schlafhorst AG & Co., Moenchengladbach, Germany

[21] Appl. No.: 647,797

[22] Filed: May 15, 1996

[30] Foreign Application Priority Data

May 31, 1995 [DE] Germany ..... 195 19 827.1

[51] Int. Cl.[6] ..... B65H 73/00; B65H 67/08

[52] U.S. Cl. ..... 28/294; 242/35.6 E

[58] Field of Search ..... 242/18 R, 18 EW, 242/35.6 E; 28/294

[56] References Cited

U.S. PATENT DOCUMENTS 3,940,825 3/1976 Murao ..... 28/294
5,220,714 6/1993 Sanno ..... 28/294

FOREIGN PATENT DOCUMENTS 30 18 788 C2 12/1989 Germany .
40 09 702 A1 10/1991 Germany .
40 25 003 A1 2/1992 Germany .

*Primary Examiner*—Andy Falik
*Attorney, Agent, or Firm*—Shefte, Pinckney & Sawyer

[57] ABSTRACT

An apparatus for pneumatically aspirating a yarn end from a spinning cop (15) with a suction nozzle (33) whose working position is adjustable has a housing (16) defining a vertical aspirating slit (19) over which a sealing belt (31) is disposed. An air passage (32) is formed in the belt (31) with the suction nozzle (33) fastened on the belt (31) about the passage (32). The belt (31) is selectively displaceable between a sealing position completely closing the aspirating slit (19) in the housing (16) and various aspirating positions wherein the air passage (32) of the belt (31) is in communication with the aspirating slit (19) of the housing (16) to apply suction through the nozzle (33) to initiate an effective, yet gentle loosening of a yarn end (46) from the conical windings (43) or the surface area of a spinning cop (41).

18 Claims, 4 Drawing Sheets

YARN END ASPIRATION APPARATUS

FIELD OF THE INVENTION

The present invention relates to a yarn end aspiration apparatus with a pneumatic yarn loosening means, whose working height can be adjusted to spinning cops with windings of different thicknesses.

BACKGROUND OF THE INVENTION

Yarn end aspiration apparatus of various types and embodiments are known for picking up and preparing a yarn end disposed on a spinning cop.

For example, German Patent Publication DE 40 09 702 A1 describes a so-called cop preparation station, wherein the yarn end is first loosened from the spinning cop surface by means of a suction nozzle pivoted in the area of the spinning cop and then aspirated. The aspirated yarn is subsequently cut to size and placed on a bobbin in such a disposition that it can be picked up again without problems in a following work cycle at the winding station.

A cop preparation device is also known from German Patent Publication DE 40 25 003 A1, which has vertically length-adjustable means controlled by sensor signals for aspirating the leading yarn end from the conical winding surfaces of cops. After being picked up, the yarn is cut to size and placed again on the cop surface such that it can be entrained in a subsequent unwinding position of the cop by an air flow and directed to a gripper. The cops are supported upright on arbors of individual carriers, at least while being processed at the cop preparation device, and the cop preparation device has drive members which rotate the cop around its longitudinal axis during the yarn search. The cop preparation device has a suction nozzle, which can be adjusted in correspondence with the conical portion of the yarn windings on the cop, and has an aspirating slit of approximately the length of the cop cone. The suction nozzle is disposed at the end of an articulated aspiration housing and can be moved parallel with the longitudinal axis of the cop.

Normally cops are completely unwound of yarn at the spinning stations of a bobbin winding frame, i.e., they leave the winding station as empty tubes. However, it can occur that a winding remnant of yarn of a more or less large size remains on the tube, whose leading yarn end can not be located to be provided to the appropriate yarn guide members or yarn connecting members in the winding station. It can also occur that spinning cops which are delivered directly from a ring spinning frame to the cop preparation station cannot be correctly processed in the preparation station to locate and properly place the leading yarn end because of an error in the ring spinning frame. Such spinning cops which can no longer be processed in a "normal" manner by preparation stations or in the winding stations are conveyed to special yarn detecting devices commonly referred to as remnant preparation devices.

Such a remnant preparation device is described in German Patent Application DE 39 18 788 A1, for example. This device has a height-adjustable, toothed contact element, which can be placed in a defined manner against the conical windings of the cop. In this case, the exact position of the conical windings is detected by means of a sensor device, for example, an optical scanner. A blower nozzle is additionally installed in the area of the contact element to generate a blown air current for assisting the loosening of the yarn end.

SUMMARY OF THE INVENTION

It is accordingly an object of the present invention to provide an improved apparatus for pneumatically aspirating a yarn end from a spinning cop of the basic type described above.

Briefly summarized, the present yarn end aspirating apparatus basically comprises a housing defining an interior chamber and a generally vertical aspirating slit opening into the chamber, means for applying a suction source to the interior chamber of the housing, and a belt sealably disposed over the aspirating slit of the housing with an air passage formed through the belt and a nozzle affixed outwardly to the belt about the air passage. In accordance with the present invention, the sealing belt is selectively displaceable relative to the housing between a sealing position wherein the aspirating slit is closed by the sealing belt, and various aspirating positions wherein the air passage of the belt is in communication with the aspirating slit of the housing to apply suction through the nozzle. In this manner, the present yarn end aspirating apparatus is adapted for use with spinning cops having yarn windings of different thicknesses.

The present invention thus results in a yarn aspiration apparatus which operates gently and yet very effectively, by clearly reducing the system-generated pressure losses of known pneumatic installations by means of a direct connection of the suction nozzle to a vacuum housing of a relatively large volume. The disposition of the suction nozzle on a sealing belt which can be moved in a defined manner offers the additional advantage that the suction nozzle can be specifically directed to defined areas of the spinning cop, i.e., to a relatively small processing area such as the conical windings of the cop. It is possible in this manner to apply to the spinning cop surface a large suction force without it being necessary to unreasonably increase the total suction output of the yarn end aspirating apparatus.

In the preferred embodiment, a drive is provided for selective displacement of the belt for positioning the nozzle into different operating positions along the aspiration slit in accordance with the yarn windings present on a spinning cop. For example, the drive preferably comprises a driveable belt deflecting roller arranged at an end of the housing with the belt being an endless belt guided at the one housing end over the deflecting roller and at the opposite housing end over a skid. This embodiment is particularly advantageous in that it is of simple construction and rugged.

A tensioning device for the sealing belt may also be disposed on the housing, which assures that the sealing effect of the sealing belt is maintained over a long period of time so that a long service life of the installation is assured.

The apparatus may additionally include means for sensing movement of the belt, e.g., a magnet wheel disposed in association with a shaft of the deflecting roller, and associated means disposed on the housing for detecting the sealing position of the belt, which offer the possibility of detecting the respective position of the conical windings of the spinning cop by means of the working height of the suction nozzle. This information can be utilized in a subsequent work cycle, for example, a further preparation device downstream, so that this subsequent preparation device does not need its own sensor device.

The housing preferably comprises a convexly curved wall in which the suction slit is formed which assures a dependable contact of the sealing belt in this critical area.

Other features of the invention further increase the effectiveness of the present yarn end aspirating apparatus. Preferably, suction is applied to the housing interior by means of a suction air connector affixed to the housing and connected with the suction source and a yarn cutting device is preferably disposed in the area of the suction air connector. A sensor may be provided for detecting the presence of a yarn end within the suction nozzle and another sensor may be utilized for detecting the position of conical yarn windings on a spinning cop disposed at the suction nozzle. This combination of features is particularly advantageous in promoting a flawless operation of the device. A pair of yarn withdrawal rollers may be disposed within the housing chamber in certain embodiments in connection with particularly critical yarns.

An auxiliary blower nozzle may be provided for directing an airstream against the cop to assist aspiration of the yarn end into the suction nozzle. For example, such a blower nozzle may be disposed stationarily at a position below the suction nozzle or alternatively may be disposed on the suction nozzle for displacement therewith. In this manner, it is possible to further increase the chances of success of the device, in particular in connection with processing of extraordinarily problematical spinning cops.

In accordance with another feature of the invention, the suction nozzle may comprise a pivotably disposed orifice element and, in one possible embodiment, the orifice element of the suction nozzle can be fixed in place in various selected angular positions. This feature promotes a more universal applicability of the present yarn end aspiration apparatus, i.e., the suction nozzle can be accurately adjusted to cops having differently structured conical windings, so that an optimal suction output is assured in each case.

The adjustment to an individual conical winding can take place manually or automatically, for example, by means of centering elements associated with the suction nozzle for centering a cop relative thereto. In particular, a placement of the suction nozzle even into the area below the conical windings of a spinning cop is possible with an automatic adjustment. The option of also applying suction to the surface area of the spinning cop, if needed, further increases the scope of employment of the device.

Further details of the invention ensue from an exemplary embodiment described below by means of the accompanying drawings.

DETAILED DESCRIPTION OF THE PREFERRED EMBODIMENT

Figure 1:
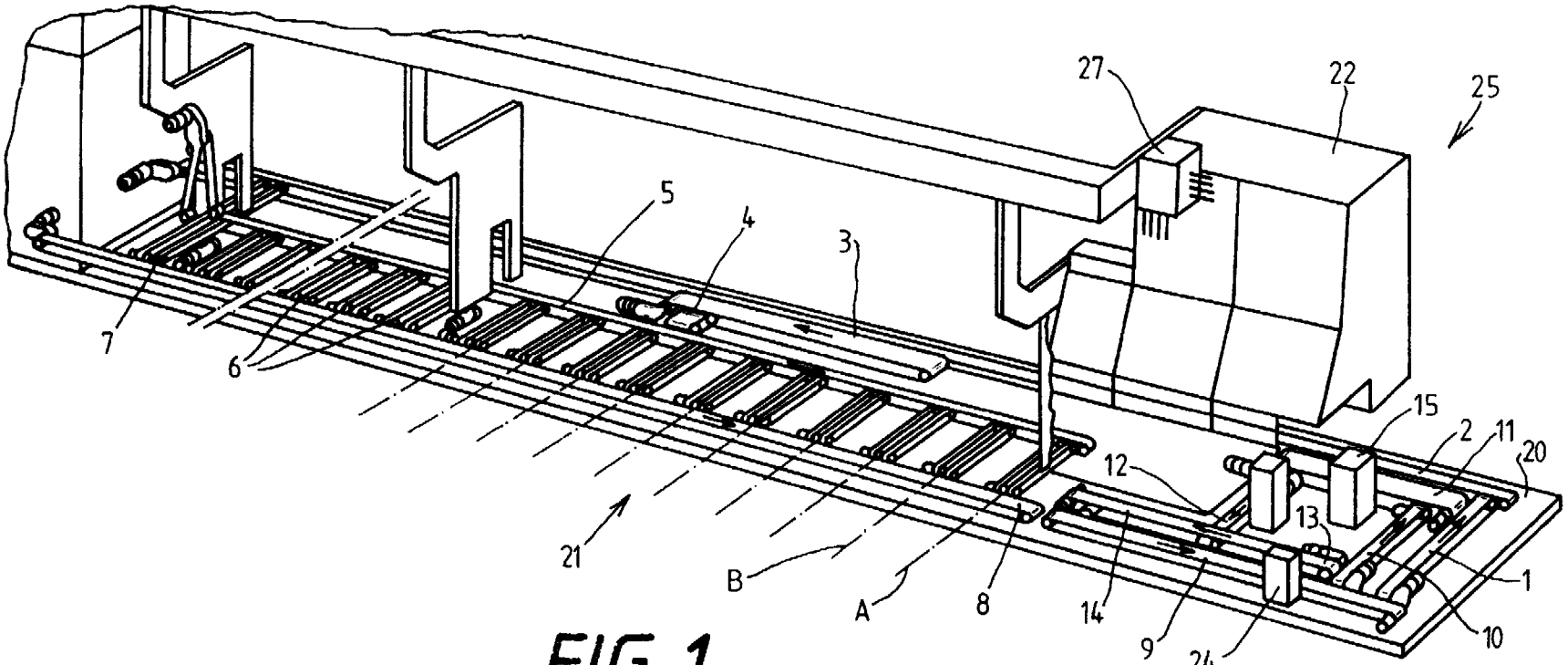
FIG. 1 is a schematic perspective representation of a bobbin carrier conveying system associated with an automatic winding machine and provided with a yarn end aspiration apparatus in accordance with a preferred embodiment of the present invention.

A perspective view of a conveying system 21 of a bobbin winding frame 25 for transporting bobbin carriers, which has been only schematically indicated without depiction of the individual winding stations for the sake of clarity, is represented in FIG. 1. Thus, the representation of the bobbin winding frame 25 is essentially limited to the drive and operating unit 22 disposed at the end of the frame, and the winding stations are indicated only by positional indications A, B, . . . etc. The bobbin carrier conveying system 21 is disposed on a frame indicated as a whole by 20. The conveying system 21 has a plurality of different conveying sections or segments, each preferably in the form of a driven endless conveyor belt, whose functions will be briefly explained below.

A bobbin transfer or "take-over" conveying segment 1 constitutes an interface of the instant conveying system with a corresponding conveying system of one or more textile machines which are located upstream in the production process. Typically, these upstream textile machines are ring spinning frames (not represented).

The yarn cops produced by the ring spinning frames are transferred to the conveying system of the bobbin winding frame and the empty tubes resulting from the winding process are returned to the ring spinning frames in the area of the take-over segment 1 by means of a bobbin transfer device (not shown). The yarn cops 41 from the spinning machines are placed on bobbin carrier pallets 63, which are part of the bobbin winding machine, and are conveyed over a delivery segment 2 of the conveying system which extends the full length of the frame for transferring the pallets onto one or several preparation segments 3, in which the reserve winding on each supported cop is loosened from the cops in preparation stations (not shown) disposed along the preparation segments 3, whereby each cop is initially prepared with a nose winding. The cops subsequently are transported over a short removal segment 4 onto a cop supply segment 5, which is alternatingly switched from right-hand to left-hand operation so as to serve as a cop storage segment. From the cop supply segment 5, the spinning cops 41 positioned on the bobbin carriers 63 reach the entry area of transverse conveying segments 6 each of which leads to a respective winding station A, B, etc. As a rule, these transverse conveying segments 6 are each adapted to receive three cops, wherein one cop is located in a winding position inside a blowing chamber (not shown in FIG. 1) of the respective winding station A, B, etc, while two further cops, also positioned on bobbin carriers, are parked along the transverse conveying segment 6 in storage or holding positions in front of the blowing chamber.

Unwound tubes are conveyed back to the take-over segment 1 over a return segment 8 at the opposite side of the winding stations and an aligned distributing segment 9. From the take-over segment 1, the unwound empty tubes are returned by means of a transfer device to the conveying system of the ring spinning frames, as indicated above.

Cops which cannot be processed by the preparation devices disposed along the preparation segments 3 are routed directly to the return segment 8 via a transversely extending connecting segment 7 and immediately reach the distributing segment 9.

A tube monitor 24 is disposed alongside the distributing segment 9 for purposes of detecting tubes having yarn remnants and is connected via a control line with a central control unit 27 of the bobbin winding frame 25.

In advance of the juncture of the end of the distributing segment 9 with the take-over segment 1, the distributing segment 9 is connected via a diverting segment 10 with a remnant preparation segment 11. In turn, the remnant preparation segment 11 connects with a repeating segment 12 and the repeating segment 12 connects with a conveyor belt segment which serves as a tube cleaning segment 13 at one end and a manual preparation segment 14 at the other end.

A yarn end aspiration apparatus 15 is disposed alongside and in association with the remnant preparation segment 11 to serve as a so-called remnant preparation station, shown in detail in FIGS. 2 to 5.

Figure 2:
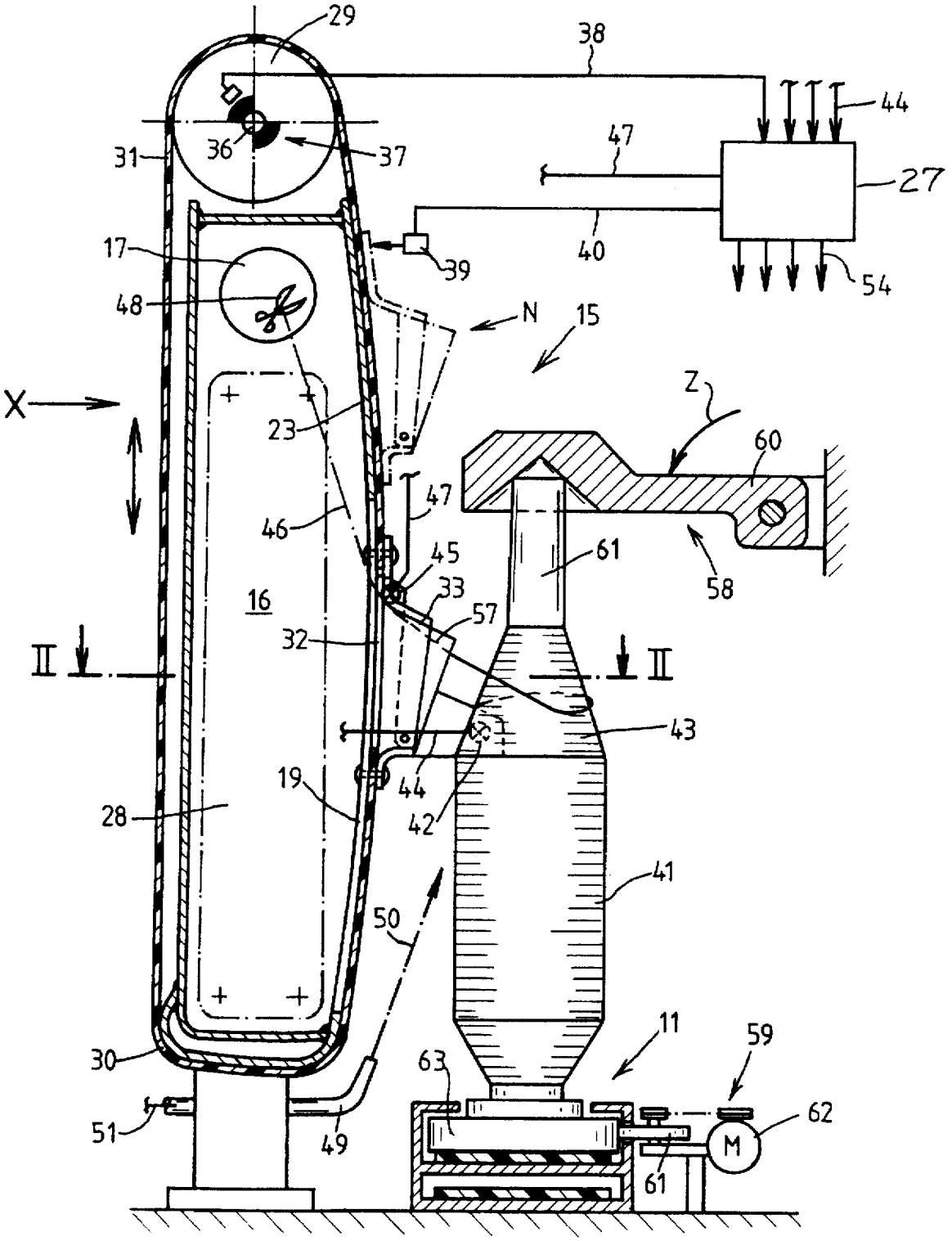
FIG. 2 is a side elevational view of the yarn end aspiration apparatus in partial section.
Figure 3:
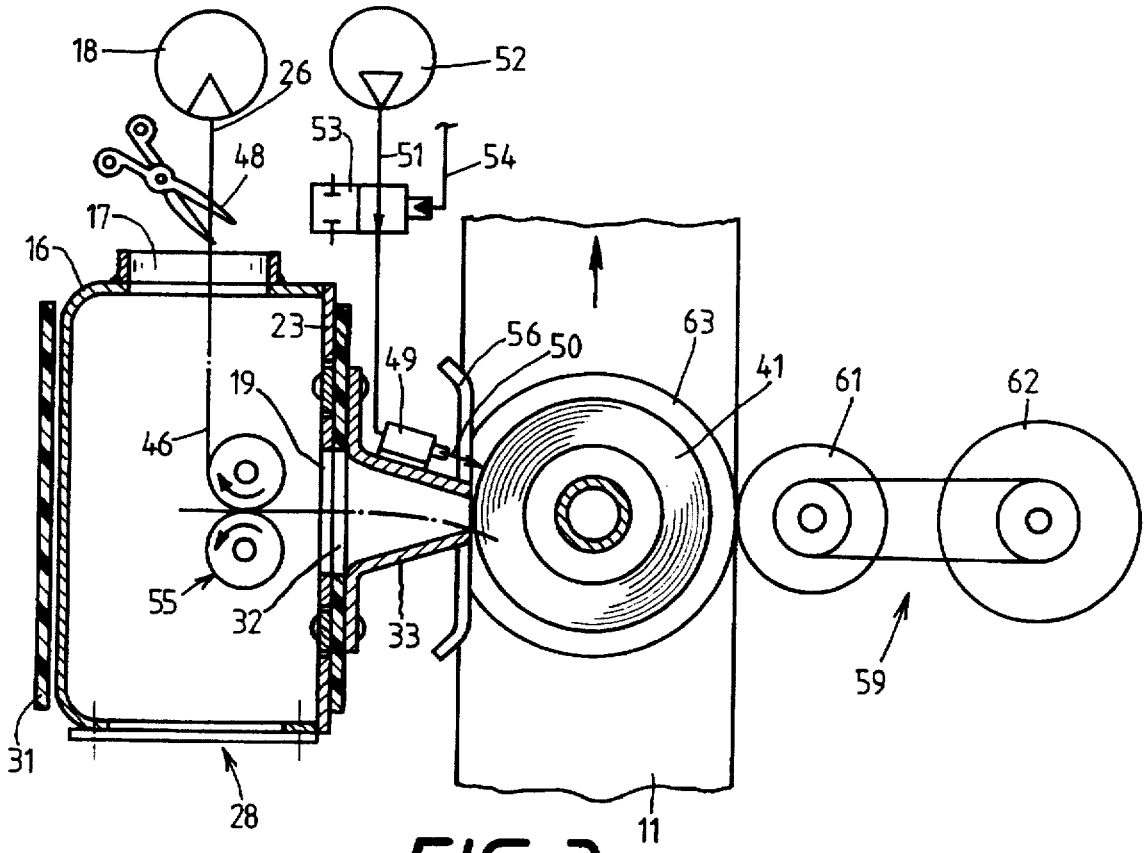
FIG. 3 is a top view on the yarn end aspiration apparatus taken in horizontal cross-section along the line II—II in FIG. 2.

As can be seen from FIG. 2 in particular, the yarn end aspiration apparatus 15 is comprised of a housing 16 of a relatively large volume, which is connected via a suction air connector 17 and a vacuum line 26 to a vacuum source 18 (see FIG. 3). In the operating state, a vacuum of approximately 60 to 90 mbar is preferably applied to the housing 16. The housing 16 has a convexly curved forward wall 23 in which is preferably formed an aspirating slit 19 configured to be vertically extending and of the approximate length of a spinning cop 41. In addition, the housing 16 has an observation window 28 in one end of the housing, which can be opened when needed so that the housing interior is accessible.

Figure 6:
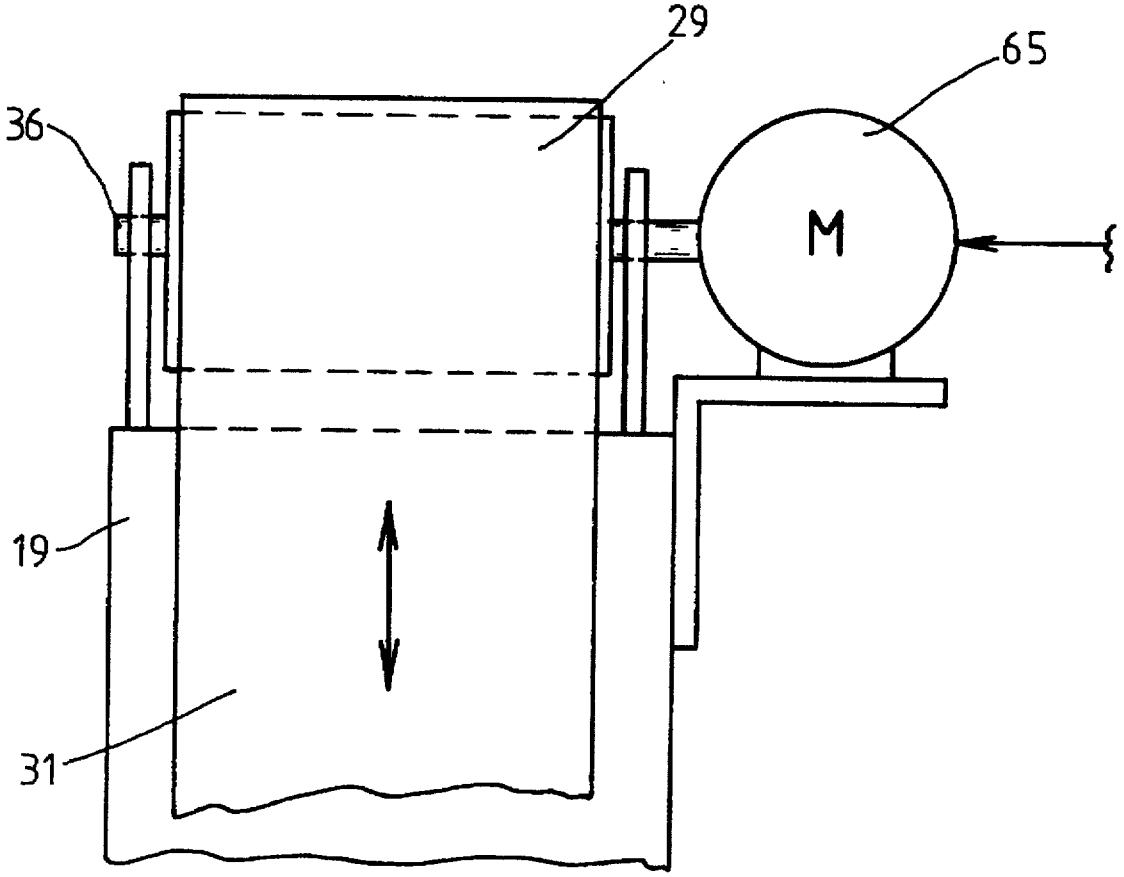
FIG. 6 is an elevational view shown from the perspective of the arrow X in FIG. 2.

Deflecting elements 29,30 are disposed at the top and the bottom of the housing 16, over which a sealing belt 31 is guided. In this case, the deflecting element 29 is preferably embodied as a deflecting roller which can be driven by a controllable drive unit 65 (FIG. 6), while the deflecting element 30 is a plate shaped as a skid. An air passage 32 is formed in the sealing belt 31 and a suction nozzle 33 is affixed to the sealing belt 31 to extend outwardly from the housing 16. In a "zero" sealing position N of the sealing belt 31, represented in dashed lines in FIG. 2, the sealing belt 31 is positioned with its air passage 32 disposed above the aspirating slit 19 in the housing 16 to completely seal the aspirating slit 19.

The sealing belt 31 can be selectively lowered from this zero position into registry with the aspirating slit 19 at differing positions along its vertical extent to locate the suction nozzle 33 in operating positions of different heights wherein the suction nozzle 33 is directly connected via the air passage 32 and the aspirating slit 19 to the large-volume vacuum housing 16 and in turn is communicated via the suction connector 17 with the vacuum source 18.

Figure 4:
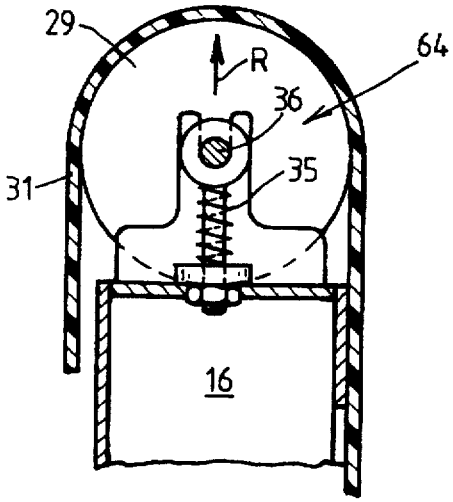
FIG. 4 is an elevational view, partially in section, of the upper area of the housing charged with a vacuum, showing in particular a tensioning device for the sealing belt.

As represented in FIG. 4, the deflecting roller 29 can be acted upon in the direction of the arrow R via a belt tensioning device 64, for example having a spring element 35, so that it is assured that the sealing belt 31 is maintained under continuous tension to rest snugly against the convex wall 23 of the housing 16.

As indicated in FIG. 2, a sensor device 37 such as a magnet wheel may be disposed in the area of the deflecting roller shaft 36. The sensor device 37 is connected via a signal line 38 to the central control unit 27 of the bobbin winding frame 25. Another sensor device 39 detects the suction nozzle 33 when in its zero position N and is also connected with the central control unit 27 via the line 40. In this manner, the central control unit 27 is enabled to exactly detect the working height of the suction nozzle 33 and, therefore, the position of the conical windings 43 of an adjacent spinning cop 41 positioned at the yarn end aspiration apparatus 15 by means of the sensor device 37 in connection with the sensor device 39. The information regarding the position of the conical windings 43 of the spinning cop 41 to be processed can be used for subsequent working cycles.

It is known to dispose a sensor device 42, preferably an optical light barrier or an optical scanner, on or in association with the suction nozzle 33, to detect the position of the conical windings 43 of the spinning cop 41 to be processed and to transmit such position via a signal line 44 to the control device 27. The suction nozzle 33 additionally has a sensor device 45 which detects the presence of a yarn end 46 within the suction nozzle 33 and also reports it via a signal line 47 to the central control unit 27.

A controllable yarn cutting device 48 is also positioned in a known manner in the area of the suction air connector 17 of the housing 16, which makes it possible to cut the yarn end 46 to a defined length.

According to a further feature of the invention, an additional blower nozzle 49 can be provided in either a stationary disposition adjacent the lower end of the housing 16, as indicated in FIG. 2, so that the air 50 is blown to flow essentially upwardly over the surface area of the spinning cop 41 or, as represented in FIG. 3, in a disposition fixed directly on the suction nozzle 33. In the latter case, the blower nozzle 49 can be height-adjusted together with the suction nozzle 33. With a blower nozzle 49 which is arranged directly on the suction nozzle 33, the blown air 50 flows preferably over the conical windings 43 of the spinning cop 41.

In each case, the blower nozzle 49 is connected via a pressure line 51 with a compressed air source 52 (see FIG. 3). A directional control valve 53 is provided in the compressed air line 51 and can be controlled in a defined manner via a control line 54.

FIG. 3 furthermore illustrates that a mechanical yarn draw-off device 55 may be provided within the housing 16 adjacent the aspirating slit 19 to assist in drawing off the aspirated yarn end 46 from the spinning cop 41.

A bobbin centering device 58 and a bobbin rotating device 59 are also disposed in the area of the yarn end aspiration apparatus 15. In this case the centering device 58 essentially comprises a centering arm 60, preferably pivotably seated, which can be moved downwardly in the direction of the arrow Z into engagement with the upper end of the tube 61 of the spinning cop 41 to be processed and thereby fixes the spinning cop 41 in the working position shown.

In a known manner, the bobbin rotating device 59 has a least one drive wheel 61 belt driven in a defined manner by means of a motor 62 to drive rotation of the spinning cop 41 selectively in or against the winding direction, as desired, via surface engagement of the wheel 61 with the bobbin carrier 63.

Function of the Device

Spinning cops which cannot be processed at the preparation stations disposed along the preparation segments 3 are routed directly to the distributing segment 9 via the connecting segment 7. In the same manner, any spinning cops which could not be correctly unwound fully in the winding stations A, B, C, etc. of the bobbin winding frame, are conveyed via the transverse conveying segments 6 to the distributing segment 9.

As indicated in FIG. 1, a tube monitor 24 is disposed along the distributing segment 9 to check the winding status of tubes transported therealong and reports the result to the central control unit 27. By means of an appropriate control of magnet switches (not shown), the central control unit 27 actuates transferral of tubes with a small remnant of yarn, cops with a usable amount of remnant yarn, and fully wound tubes with an unprepared leading yarn end onto the diverting segment 10, by which the tubes or cops are transported onto the remnant preparation segment 11, the repeating segment 12 or the tube cleaning segment 13, depending on the state of their winding.

The thusly diverted spinning cops 41 reach the yarn end aspiration apparatus 15 in the area of the remnant preparation segment 11 and are oriented and held thereat in a working position by the centering device 58, as shown in FIG. 2. In this manner, the spinning cop 41 placed on its associated bobbin carrier 63 is thusly positioned adjacent the vacuum-charged housing 16 and adjacent the height-adjustable suction nozzle 33 thereon. The bobbin rotating device 59 is simultaneously pivoted into driving engagement against the bobbin carrier 63.

Next, the suction nozzle 33 disposed on the sealing belt 31 is lowered from its zero position N by driving the sealing belt in the clockwise direction (as viewed in FIG. 2) until the sensor device 42 disposed on the suction nozzle 33 detects the upper conical windings 43 of the spinning cop 41. In the course of lowering the suction nozzle 33, its air passage 32 comes into registry with the aspirating slit 19 in the housing 16. A dramatic surge or jolt of suction occurs in the process through the orifice of the suction nozzle 33 because of the relatively large volume of the vacuum housing 16, and the relatively strong suction flow dependably loosens the leading end of yarn 46 from the cop surface. The bobbin carrier 63 and the spinning cop 41 are simultaneously rotated by the bobbin rotating device 59 opposite the direction of yarn windings on the cop, whereby a length of the yarn end 46 is aspirated into the housing 16 via the suction nozzle 33. In the process, the sensor device 45 detects the successful capture of the yarn end 46. The yarn end 46 is subsequently cut to a defined length by the yarn cutting device 48 and is placed on the conical windings 43 or the upper end tip of the tube in a location and disposition where it is easy to pick up by means of switching the rotation of the bobbin turning device 59 into the winding direction of the spinning cop 41.

The loosening of the yarn end 46 from the cop surface is assisted by the blower nozzle 49 disposed either at the lower end of the remnant preparation device or directly on the suction nozzle 33. Depending on the arrangement, the blown air 50 from the blower nozzle 49 flows either predominantly over the surface area of the spinning cop 41 or in a directed manner over the area of the conical windings 43.

In addition, it is possible to assist the withdrawal of the yarn end 46 from the cop surface upon aspiration into the housing 16 by the yarn draw-off device 55 installed in the interior of the housing 16. This yarn draw-off device 55 is accessible when required through the observation window 28 which can be disassembled.

Figure 5:
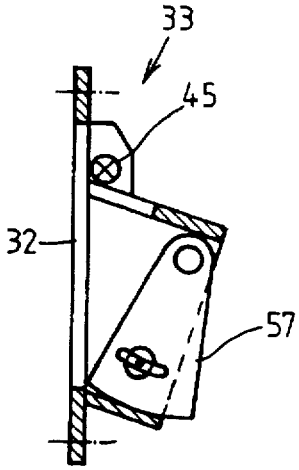
FIG. 5 is an elevational view of a further embodiment of a suction nozzle.

Various embodiments of the shape of the suction nozzle 33 are conceivable. For example, the shape of the orifice area of the suction nozzle 33 can be fixedly matched to the inclination angle of the conical windings 43 of the spinning cops 41 to be processed or, as indicated in FIGS. 2 and 5, can be embodied as a pivoting structure. In the embodiment illustrated in FIG. 5, a pivoting orifice element 57 can be adjustably fixed in various angular positions. In the embodiment according to FIG. 2, the pivotably seated orifice element 57 automatically adapts itself to the surface of the spinning cop.

In particular, the variant represented in FIG. 2 is designed such that the orifice element 57 can be easily pivoted back into the suction nozzle 33, so that the nozzle has a more vertically disposed orientation making it possible, if required, to cover the surface area of the spinning cop 41 over its entire length.

The suction nozzle 33 may also be provided with lateral centering elements 56 (FIG. 3), which prevent the uncontrolled approach of the pivotably disposed orifice element 57 to the spinning cop 41.

The invention is not to be limited to the exemplary embodiments represented. Further variants are easily possible, for example, regarding the shape of the suction nozzle, the design of the vacuum-charged housing or the drive of the sealing belt, etc., without departing from the general scope of the invention.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. Apparatus for pneumatically aspirating a yarn end from a spinning cop adapted for use with spinning cops having yarn windings of different thicknesses, the apparatus comprising:

a housing defining an interior chamber and a generally vertical aspirating slit opening into the chamber, means for applying a suction source to the interior chamber of the housing, a belt sealably disposed over the aspirating slit of the housing and having an air passage formed through the belt and a nozzle affixed outwardly to the belt about the air passage, and a drive for displacement of the belt relative to the housing between a sealing position wherein the aspirating slit is closed by the sealing belt, and at least one aspirating position wherein the air passage of the belt is in communication with the aspirating slit of the housing to apply suction through the nozzle.

2. Apparatus for pneumatically aspirating a yarn end from a spinning cop in accordance with claim 1, wherein the drive selectively displaces the belt for positioning the nozzle into different operating positions along the aspiration slit in accordance with the yarn windings present on a spinning cop.

3. Apparatus for pneumatically aspirating a yarn end from a spinning cop in accordance with claim 2, wherein the drive comprises a driveable belt deflecting roller arranged at an end of the housing.

4. Apparatus for pneumatically aspirating a yarn end from a spinning cop in accordance with claim 3, wherein the belt is an endless belt guided at the one housing end over the deflecting roller and at the opposite housing end over a skid.

5. Apparatus for pneumatically aspirating a yarn end from a spinning cop in accordance with claim 1, and further comprising a tensioning device for the sealing belt disposed on the housing.

6. Apparatus for pneumatically aspirating a yarn end from a spinning cop in accordance with claim 3, and further comprising a means for sensing movement of the belt including a magnet wheel disposed in association with a shaft of the deflecting roller.

7. Apparatus for pneumatically aspirating a yarn end from a spinning cop in accordance with claim 1, and further comprising means disposed on the housing for detecting the sealing position of the belt.

8. Apparatus for pneumatically aspirating a yarn end from a spinning cop in accordance with claim 1, wherein the housing comprises a convexly curved wall in which the aspirating slit is formed.

9. Apparatus for pneumatically aspirating a yarn end from a spinning cop in accordance with claim 1, wherein the suction source applying means comprises a suction air connector affixed to the housing and connected with the suction source and a yarn cutting device disposed in the area of the suction air connector.

10. Apparatus for pneumatically aspirating a yarn end from a spinning cop in accordance with claim 1, and further comprising a pair of yarn draw-off rollers disposed within the housing chamber.

11. Apparatus for pneumatically aspirating a yarn end from a spinning cop in accordance with claim 1, and further comprising an auxiliary blower nozzle for directing an airstream against the cop to assist aspiration of the yarn end into the suction nozzle.

12. Apparatus for pneumatically aspirating a yarn end from a spinning cop in accordance with claim 11, wherein the blower nozzle is disposed stationarily at a position below the suction nozzle.

13. Apparatus for pneumatically aspirating a yarn end from a spinning cop in accordance with claim 11, wherein the blower nozzle is disposed on the suction nozzle for displacement therewith.

14. Apparatus for pneumatically aspirating a yarn end from a spinning cop in accordance with claim 1, and further comprising a sensor for detecting the presence of a yarn end within the suction nozzle.

15. Apparatus for pneumatically aspirating a yarn end from a spinning cop in accordance with claim 1, and further comprising a sensor for detecting the position of conical yarn windings on a spinning cop disposed at the suction nozzle.

16. Apparatus for pneumatically aspirating a yarn end from a spinning cop in accordance with claim 1, wherein the suction nozzle comprises a pivotably disposed orifice element.

17. Apparatus for pneumatically aspirating a yarn end from a spinning cop in accordance with claim 1, wherein the suction nozzle comprises an orifice element pivotally disposable into various angular positions.

18. Apparatus for pneumatically aspirating a yarn end from a spinning cop in accordance with claim 1, and further comprising centering elements associated with the suction nozzle for centering a cop relative thereto.

* * * * *